US006554566B1

(12) United States Patent
Nigmatulin

(10) Patent No.: US 6,554,566 B1
(45) Date of Patent: Apr. 29, 2003

(54) TURBINE SHROUD COOLING HOLE DIFFUSERS AND RELATED METHOD

(75) Inventor: Tagir Nigmatulin, Greenville, SC (US)

(73) Assignee: General Electric Company, Schenectady, NY (US)

( * ) Notice: Subject to any disclaimer, the term of this patent is extended or adjusted under 35 U.S.C. 154(b) by 30 days.

(21) Appl. No.: 09/983,996

(22) Filed: Oct. 26, 2001

(51) Int. Cl.[7] ..... F01D 11/08
(52) U.S. Cl. ..... 415/139; 415/173.1; 415/176
(58) Field of Search ..... 415/173.1, 176, 415/1, 139

(56) References Cited

U.S. PATENT DOCUMENTS 5,088,888 A * 2/1992 Bobo ..... 415/170.1
5,375,973 A * 12/1994 Sloop et al. ..... 415/173.1
5,480,281 A 1/1996 Correia
6,065,928 A 5/2000 Rieck, Jr. et al.
6,113,349 A 9/2000 Bagepalli et al.
6,126,389 A 10/2000 Burdgick
6,155,778 A * 12/2000 Lee et al. ..... 415/116
6,243,948 B1 6/2001 Lee et al.
6,261,053 B1 * 7/2001 Anderson et al. ..... 415/115

* cited by examiner

*Primary Examiner*—Ninh Nguyen
(74) *Attorney, Agent, or Firm*—Nixon & Vanderhye P.C.

(57) ABSTRACT

An inner shroud assembly for a turbine comprising a plurality of part-annular segments combining to form an inner, annular shroud adapted to surround rotating components of a turbine, each segment having a pair of end faces that are juxtaposed similar end faces on adjacent segments with gaps therebetween; at least one convection cooling hole in the segment, opening along at least one of the pair of end faces. The cooling hole opens specifically into a diffuser recess formed in one of the pair of end faces for diffusing the flow of cooling air into the gap.

9 Claims, 2 Drawing Sheets

TURBINE SHROUD COOLING HOLE DIFFUSERS AND RELATED METHOD

BACKGROUND OF THE INVENTION

The present invention relates to impingement cooling for a shroud assembly surrounding the rotating components in the hot gas path of a gas turbine, and particularly relates to supplying purge air to the gaps between the inner shroud segments to cool the segments and to prevent hot gas ingestion into the gaps.

Shrouds employed in a gas turbine surround and in part define the hot gas path through the turbine. Shrouds are typically characterized by a plurality of circumferentially extending shroud segments arranged about the hot gas path, with each segment including discrete inner and outer shroud bodies. Conventionally, there are two or three inner shroud bodies for each outer shroud body, with the outer shroud bodies being secured by dovetail-type connections to the stationary inner shell of the turbine and the inner shroud bodies being secured by similar dovetail connections to the outer shroud bodies. The inner shroud segments directly surround the rotating parts of the turbine, i.e., the rotor wheels carrying rows of buckets or blades. Because the inner shroud segments are exposed to hot combustion gases in the hot gas path, systems for cooling the inner shroud segments are oftentimes necessary to reduce the temperature of the segments. This is especially true for inner shroud segments in the first and second stages of a turbine that are exposed to very high temperatures of the combustion gases due to their close proximity to the turbine combustors. Heat transfer coefficients are also very high due to rotation of the turbine buckets or blades. To cool the shrouds, typically relatively cold air from the turbine compressor is supplied via convection cooling holes that extend through the segments and into the gaps between the segments to cool the sides of the segments and to prevent hot path gas ingestion into the gaps. The area that is purged and cooled by the flow from a single cooling hole is small, however, because the velocity of the cooling air exiting the cooling hole is high, and the cooling air diffuses like a jet and flows into the hot gas flow path.

Previous design methods thus required multiple cooling holes in close proximity to each other, using increased amounts of cooling air from the compressor (and additional machining) which, in turn, reduces the efficiency of the turbine.

BRIEF SUMMARY OF THE INVENTION

In an exemplary embodiment of the invention, a cooling circuit for purging cooling air into the gaps between inner shroud segments includes convection holes that incorporate diffusers at their respective outlet ends. Each diffuser may include an elongated, substantially rectangularly-shaped outlet recess or cavity with a cross-section that tapers away from (i.e., increases outwardly from) the respective convection hole, terminating at the face of the segment. More specifically, the convection hole extends at an angle of about 45° relative to the segment face, opening into the diffuser recess near a rearward or upstream end of the recess, relative to the direction of purge or cooling flow. The diffuser recess includes a long tapered portion extending in the flow direction (or forward of the convection hole) and a short tapered portion extending in a direction opposite the flow direction. The end result is that the cooling or purge air begins to diffuse before it reaches the face of the segment, enhancing the cooling of the segment edges. While the cooling or purge air does lose some velocity in the diffuser, sufficient pressure is maintained to prevent hot gas path gases from entering the gaps between the inner shroud segments.

Accordingly, in its broader aspects, the invention relates to an inner shroud assembly for a turbine comprising a plurality of part-annular segments combining to form an inner, annular shroud adapted to surround rotating components of a turbine, each segment having a pair of end faces that are juxtaposed similar end faces on adjacent segments with gaps therebetween; at least one convection cooling hole in the part segment, opening along at least one of the pair of end faces; said at least one cooling hole opening into a diffuser recess formed in one of the pair of end faces for diffusing the flow of cooling air into the gap.

In another aspect, the invention relates to a segment for a turbine shroud assembly comprising a segment body having a sealing face and opposite end faces; and at least one convection cooling hole extending through the segment body and opening into a diffuser recess formed in a respective end face of the segment body.

In still another aspect, the invention relates to a method of purging cooling air into gaps between adjacent part annular segments in a turbine shroud assembly comprising a) supplying cooling air through one or more cooling holes formed in each segment, each cooling hole opening along an end face of the segment; and b) diffusing the cooling air before it reaches the end face of each segment.

DETAILED DESCRIPTION OF THE INVENTION

Figure 1:
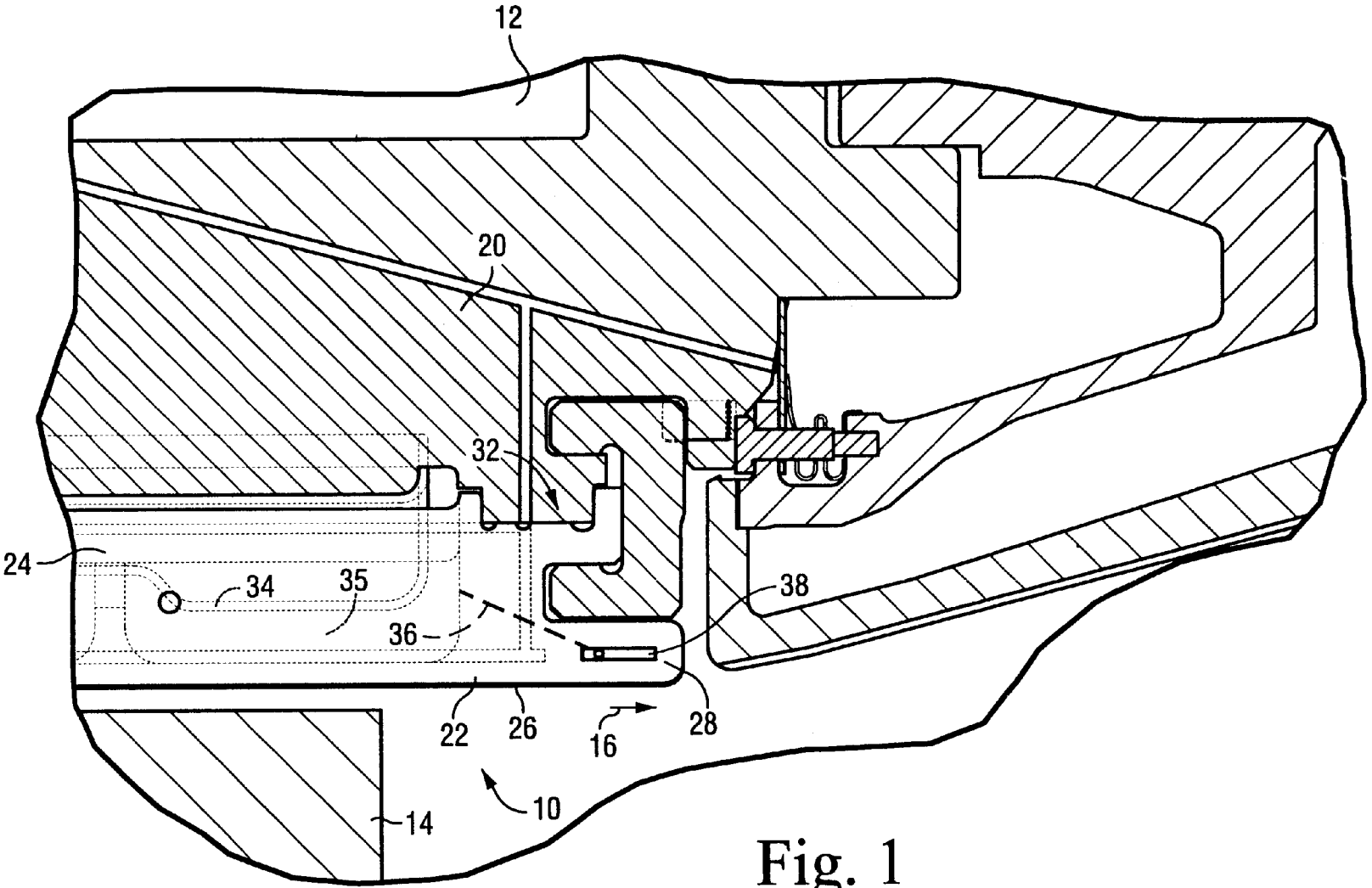
FIG. 1 is a simplified partial section of a turbine inner shroud segment located between a first stage bucket and a second stage nozzle, incorporating an inner shroud diffuser in accordance with the invention.

Referring now to FIG. 1, there is illustrated portions of a shroud system 10 surrounding the rotating components in the hot gas path of a gas turbine. The shroud system 10 is secured to a stationary inner shell of the turbine housing 12 and surrounds the rotating buckets or vanes 14 disposed in the hot gas path. The portions of shroud system 10 shown in FIG. 1 are for the first stage of the turbine, and the direction of flow of the hot gas is indicated by the arrow 16. The shroud system 10 includes outer and inner shroud segments 20 and 22, respectively. It will be appreciated that the shroud system includes a plurality of such segments arranged circumferentially relative to one another with two or three inner shroud segments 22 connected to each one of the outer shroud segments 20. For example, there may be on the order of forty-two outer shroud segments circumferentially adjacent one another and eighty-four inner shroud segments circumferentially adjacent one another, with a pair of inner shroud segments being secured to an outer shroud segment, and with gaps between adjacent inner segments. The individual inner shroud segments that are of interest here are substantially identical, and thus only one need be described in detail.

The segment 22 includes a segment body 24 having a radially inner face 26 that mounts a plurality of labyrinth seal teeth, or a combination of labyrinth seal teeth, brush and/or cloth seals (not shown). Each segment body is formed with substantially identical circumferential end faces, one of which is shown at 28. Segment 22 is mounted to an outer shroud segment 20 by a conventional hook and C-clip arrangement at 32.

Figure 2:
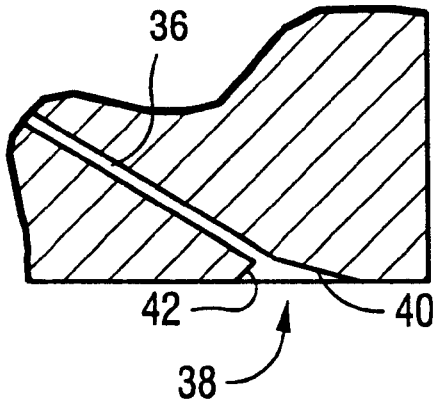
FIG. 2 is a horizontal section taken through the diffuser portion of the inner shroud segment shown in FIG. 1.

Cooling air from the turbine compressor is supplied via impingement cavity 34 that receives the cooling air through an impingement plate 35 to at least one convection hole 36 (one shown) drilled through the segment 22 and opening into a diffuser recess 38 at the circumferential end face 28 of the segment. With specific reference to FIG. 2, the diffuser recess includes an extended taper 40 in the downstream or flow path direction, and a shorter and more sharply angled taper 42 in the upstream or counter flow path direction, with the hole 36 opening into the rearward portion of the recess, where tapers 40 and 42 intersect. With this arrangement, cooling air flowing through the hole 36 will rapidly diffuse into the larger downstream portion of the recess 38 and then into the circumferential gap between adjacent segments. The diffused cooling air thus convection cools a larger portion of the segment, and impingement cools a larger portion of the adjacent segment. At the same time, sufficient pressure is maintained to prevent any ingestion of hot gas path gases into the gap between adjacent segments.

Figure 3:
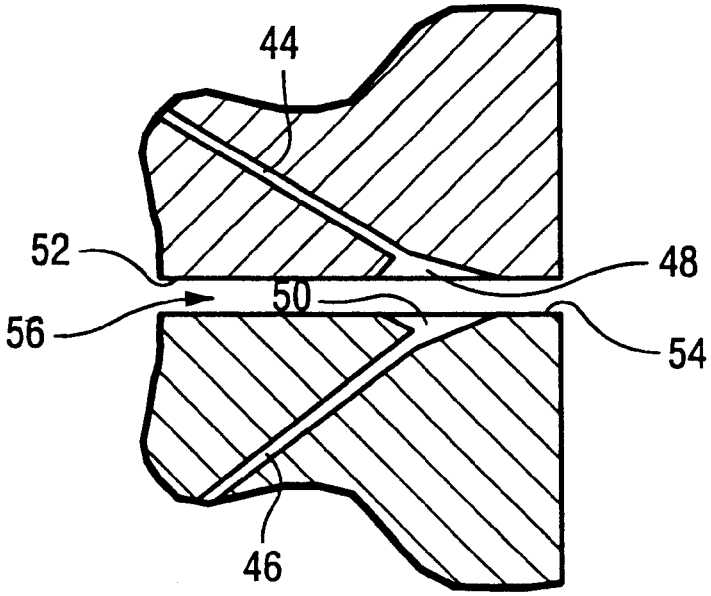
FIG. 3 is a horizontal section similar to FIG. 2, but illustrating the arrangement of a pair of diffusers in adjacent shroud segments.

FIG. 3 illustrates how adjacent convection holes 44, 46 and associated respective diffuser recesses 48, 50 on adjacent segment faces 52, 54 are juxtaposed, and supply cooling air into the gap 56 between the segments. This arrangement is repeated throughout the annular array of inner shroud segments.

While the diffuser recesses are shown to be of rectangular shape, the invention is not limited to any particular shape so long as the cooling air is sufficiently diffused.

By diffusing the cooling air before the cooling air reaches the segment end face, and as the cooling air discharged into the gap between adjacent segments, the effectiveness of the convection cooling holes is increased.

The invention has been described primarily with respect to inner shroud segments in the first and second stages of a gas turbine, but the invention is applicable to any segmented shroud or seal where cooling and/or purge air is supplied to gaps between the segments.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An inner shroud assembly for a turbine comprising:

a plurality of part-annular segments combining to form an inner, annular shroud adapted to surround rotating components of a turbine, each segment having a pair of end faces that are juxtaposed similar end faces on adjacent segments with gaps therebetween; at least one convection cooling hole in the segment, opening along at least one of said pair of end faces; said at least one cooling hole opening into a diffuser recess formed in said one of said pair of end faces for diffusing the flow of cooling air into said gap; wherein said diffuser recess is substantially elongated in shape, with lengthwise surfaces on opposite sides of said at least one cooling hole tapering inwardly toward said cooling hole.

2. The inner shroud of claim 1 wherein a major one of said lengthwise surfaces extends downstream of said at least one cooling hole.

3. The inner shroud of claim 1 wherein said at least one convection cooling hole has a diameter substantially equal to a width dimension of said diffuser recess.

4. The inner shroud of claim 1 wherein each segment has at least one additional convection cooling hole opening into a diffuser recess along the other of said pair of end faces.

5. A segment for a turbine shroud assembly comprising:

a segment body having a sealing face and opposite end faces; and at least one convection cooling hole extending through said segment body and opening into a diffuser recesses formed in a respective end face of said segment body; wherein said diffuser recess is substantially rectangular in shape, with lengthwise surfaces on opposite sides of the convection cooling hole tapering toward said convection cooling hole.

6. The segment of claim 5 wherein a major one of said lengthwise surfaces extends downstream of said convection cooling hole.

7. The segment of claim 5 wherein said convection cooling hole has a diameter substantially equal to a width dimension of said diffuser recess.

8. A method of purging cooling air into gaps between adjacent part annular segments in a turbine shroud assembly comprising:

a) supplying cooling air through one or more cooling holes formed in each segment, each cooling hole opening along an end face of the segment; and b) diffusing the cooling air before it reaches the end face of each said segment.

9. The inner shroud of claim 5 wherein each segment has at least one additional convection cooling hole opening into a diffuser recess along the other of said pair of end faces.

* * * * *